US008960263B2

(12) United States Patent
Watts et al.

(10) Patent No.: US 8,960,263 B2
(45) Date of Patent: Feb. 24, 2015

(54) CENTRIFUGAL CASTING METHOD AND APPARATUS

(71) Applicant: United States Pipe and Foundry Company, LLC, Birmingham, AL (US)

(72) Inventors: Kenneth J Watts, Alpine, AL (US); Terry M Wood, Homewood, AL (US)

(73) Assignee: United States Pipe and Foundry Company, LLC, Birmingham, AL (US)

( * ) Notice: Subject to any disclaimer, the term of this patent is extended or adjusted under 35 U.S.C. 154(b) by 0 days.

(21) Appl. No.: 14/219,825

(22) Filed: Mar. 19, 2014

(65) Prior Publication Data

US 2014/0262112 A1 Sep. 18, 2014

Related U.S. Application Data

(62) Division of application No. 13/842,303, filed on Mar. 15, 2013, now Pat. No. 8,733,424.

(51) Int. Cl.

| | |
|---|---|
| ***B22D 13/00*** | (2006.01) |
| ***B22D 13/10*** | (2006.01) |
| ***B22D 13/12*** | (2006.01) |
| ***B22D 46/00*** | (2006.01) |
| ***B22D 13/02*** | (2006.01) |

(52) U.S. Cl.

CPC ..... *B22D 13/12* (2013.01); *B22D 13/023* (2013.01); *B22D 13/107* (2013.01)

USPC ..... 164/286; 164/301; 164/117; 164/154.6; 164/457

(58) Field of Classification Search

CPC ..... B22D 13/00; B22D 13/02; B22D 13/023; B22D 13/108; B22D 13/101; B22D 13/12

USPC ..... 164/114–118, 175, 286–301, 154.6, 164/457

See application file for complete search history.

(56) References Cited

U.S. PATENT DOCUMENTS

| | | | |
|---|---|---|---|
| 2,763,041 | A | 9/1956 | Doat |
| 2,832,108 | A | 4/1958 | Vossberg |
| 2,943,369 | A | 7/1960 | Szwed |

(Continued)

OTHER PUBLICATIONS

Heraeus, "Thermal Analysis of Cast Iron", retrieved from https://web.archive.org/web/20100329004803/http://heraeus-electro-nite.com/media/webmedia_local/media/downloads/iron_1/thermalanalysis/thermalanalysisofcastironmay2007.pdf. Mar. 29, 2010.*

(Continued)

*Primary Examiner* — Kevin P Kerns
*Assistant Examiner* — Steven Ha
(74) *Attorney, Agent, or Firm* — Paul Sykes; Bradkley Arant Boult Cummings LLP

(57) ABSTRACT

A method and apparatus for centrifugal casting, in which transfer functions are developed relating the fluidity of molten metal, for example iron of varying composition, to casting machine movement for a particular mold in order to cast objects, for example pipe, having desired and uniform characteristics, including wall thickness. Fluidity is calculated for each pour of molten metal based on the measured pour temperature and measured liquidus arrest temperature. A drive system controlled by a programmable logic controller moves the casting machine in accordance with the output of the transfer functions based on the calculated fluidity.

12 Claims, 6 Drawing Sheets

(56) References Cited

U.S. PATENT DOCUMENTS

| | | | | |
|---|---|---|---|---|
| 3,056,179 | A | 10/1962 | Lorang | |
| 4,036,279 | A | 7/1977 | Nieman | |
| 4,316,495 | A | 2/1982 | Pierrel | |
| 4,370,719 | A | 1/1983 | Upchurch | |
| 4,483,387 | A * | 11/1984 | Chielens et al. | 164/455 |
| 4,796,688 | A | 1/1989 | Gundlach | |
| 6,817,403 | B2 * | 11/2004 | Hunter | 164/169 |
| 7,770,628 | B2 | 8/2010 | Simpson | |
| 8,186,421 | B1 | 5/2012 | Carter | |
| 8,327,912 | B2 | 12/2012 | Terada | |
| 2004/0182538 | A1 | 9/2004 | Lambrecht | |
| 2008/0023172 | A1 | 1/2008 | Waugh | |
| 2008/0083525 | A1 * | 4/2008 | Schlichting et al. | 164/463 |
| 2009/0090483 | A1 * | 4/2009 | Simpson et al. | 164/457 |
| 2009/0308562 | A1 | 12/2009 | Rauguth | |
| 2012/0048429 | A1 | 3/2012 | Waugh | |

OTHER PUBLICATIONS

Nolen, L.A. "Transactions of the American Foundrymen's Society—Proceedings of the Seventy-Fourth Annual Meeting"; Apr. 6 to Apr. 10, 1970; vol. 78; pp. 1-3 and 269-272.

* cited by examiner

Flag Delay Time Equation

Bell Acceleration Equation

Spigot Deceleration Equation

Spigot Check Equation

CENTRIFUGAL CASTING METHOD AND APPARATUS

CROSS-REFERENCE TO RELATED APPLICATIONS

This application is a divisional of U.S. patent application Ser. No. 13/842,303, filed Mar. 15, 2013 (currently pending) and claims the benefit thereof and priority thereto.

TECHNICAL FIELD

The invention relates generally to the field of centrifugally casting metal objects, and more specifically, to the field of centrifugally casting of iron pipe.

BACKGROUND

The process of centrifugal casting of metal objects, and in particular of iron pipe, is well known and has been practiced for nearly a century. A centrifugal casting machine includes a delivery system, such as a trough, and a rotating mold. Molten iron is poured from a machine ladle into the trough. The trough extends into the interior of the rotating mold, generally axially. One end of the mold usually includes a core, such as a sand core, to accurately shape what is called the bell of the pipe. The opposite end of the pipe is referred to as the spigot, and the elongated section in between is the barrel. The molten iron flows down the trough under the influence of gravity. The mold and trough are moved relative to one another to fill the mold with iron, typically from the bell end along the barrel to the spigot. As the mold rotates, centrifugal force disposes the iron circumferentially around the mold in a relatively even manner. Typically, the casting machine is moved via hydraulics or other mechanical means, as is known in the art, to dispose the iron as desired.

Variation in the charge mix (i.e., the source of raw material for the foundry, such as scrap iron), coke, and cupola operation results in variation in the molten iron temperature and chemical composition. This in turn causes variations in frictional forces, surface tension, heat diffusivity, and fluidity of the molten iron from which each pipe is cast, resulting in inconsistency in the flow rate of iron to the mold. Even with hydraulic systems controlled by programmable logic controllers (PLCs), uniformity of results and adherence to specifications can be difficult to achieve. For example, the wall thickness of the pipe may not be uniform from end to end. The casting operator cannot detect changes in the iron that affect wall thickness uniformity in a timely manner in order to adjust the casting machine controls. The variation in molten iron content cannot be cost effectively eliminated in a facility using material from recycled or scrap sources.

The variation in content of the molten iron manifests itself in the liquidus arrest temperature and the fluidity of the molten iron. The liquidus arrest temperature (LA) is the temperature at which a molten metal changes phase to a solid state. While the liquidus arrest temperature may be calculated if the precise chemical composition of the molten metal is known, that composition may not be known. This is true, for example, in foundries using scrap or other recycled sources of metal, which contain varying amounts of the key chemicals carbon, silicon, and phosphorous, as well as amounts of unknown materials that may affect the fluidity of the alloy.

The variations in the liquidus arrest temperature cause variations in the fluidity of molten metal at a given temperature. Fluidity is a technological characteristic of molten metal that indicates how well the molten metal flows into a mold.

Fluidity is driven by metallostatic pressure and hindered by surface tension, heat diffusivity, and friction. The term fluidity, as used in the foundry industry and as used herein, is different than the usage by physicists, who use the term as the reciprocal of viscosity. Fluidity is quantified in terms of the distance (inches) a molten metal such as iron will flow through a standard fluidity spiral pattern until solidification blocks the flow.

The fluidity of molten iron may be expressed in terms of a carbon equivalent or composition factor according to known equations.

$$\text{Fluidity}=14.9*\text{CE}+0.05T-155 \quad (1)$$

where CE is a quantity known as carbon equivalent and T is pour temperature. CE may be expressed as follows:

$$\text{CE}=\%\ \text{C}+\tfrac{1}{4}\%\ \text{Si}+\tfrac{1}{2}\%\ \text{P} \quad (2)$$

Carbon equivalent can be used to approximate the liquidus arrest temperature LA according to the following equation:

$$\text{LA}=(\text{CE}-15.38)/(-0.005235) \quad (3)$$

However, where the chemical composition of the molten iron varies, such as when the casting process uses scrap or recycled materials rather than pig iron from foundries for the melts, the combined effects of such variation have effects on the liquidus arrest temperature that are not accounted for in the equation above and it is no longer accurate.

Fluidity has a determinative influence on the volume of iron delivered over time to the mold. The volume of iron entering the mold per unit time initially increases as the trough is filled with iron from the initial tilting of the ladle. The volumetric delivery rate of iron to the mold typically reaches a steady state during the middle of the casting process, and then when the ladle is cut back at the end of the pour, the delivery of iron decreases. The rate of the increase, the volumetric steady state achieved, and the rate of decrease are all a function of fluidity.

Fluidity is affected not only by the liquidus arrest temperature, but also by the pour temperature of the molten metal. Multiple objects may be cast from a single container of molten metal, and the metal cools over time, such that the fluidity of the molten metal used for the last casting may be significantly less than the fluidity of the molten metal from the same batch used for the first object. Thus, if the casting machine movement remains the same from the first to the last object, the two objects will likely have different physical properties as cast, such as differences in wall thickness.

Fluidity thus presents a compound problem. Fluidity may change from batch to batch of molten iron as the composition varies, and fluidity may change from pour to pour of the same batch as the molten iron cools. Further, the actual fluidity of the molten iron to be used in a casting cannot be known until it is poured into the trough.

Current casting machine technology does not account for these variations in fluidity and does not provide any way to adjust casting machine movement based on the actual fluidity of the molten iron traveling down the trough toward the mold. As a result, casting machine controls must be set to account for near worst-case fluidity to ensure all pipe are within specification. This, however, may result in pipe lacking uniformity in wall thickness and requires acceptance of wide tolerances with respect to specification. Casting of thin-walled pipe is therefore highly challenging using current technology.

Thus, there is a need for an apparatus and method that measures and accounts for changes in fluidity with each casting in order to centrifugally cast metal objects with uniform results and close adherence to predetermined specifications.

SUMMARY

Embodiments of the present invention satisfy these needs, but it should be understood that not all embodiments satisfy each need. One embodiment comprises a method of centrifugally casting an object from a container of molten metal comprising measuring the liquidus arrest temperature of the molten metal in the container, pouring the molten metal into a trough to deliver the molten metal to a rotating mold, measuring the pour temperature of the molten metal poured into the trough, calculating the fluidity of the molten metal based upon the measured liquidus arrest temperature and measured pour temperature, and moving the mold relative to the trough to dispose molten metal into the mold, wherein the movement is controlled based on the calculated fluidity to deliver a volume of molten metal to the mold to cast the object in accordance with predetermined specifications. In one embodiment, the movement is controlled in accordance with a transfer function relating fluidity to volumetric requirements for an object of said predetermined specifications on said mold. The object may be, for example, an iron pipe having a specified wall thickness.

Another embodiment comprises a method of developing control equations to relate the fluidity of molten metal to the volumetric requirements of a rotating mold for centrifugally casting an object from molten metal poured from a container. The method comprises recording the liquidus arrest temperature of the molten metal in the container; pouring the molten metal into a trough to deliver the molten metal to a rotating mold; recording the pour temperature of the molten metal poured into the trough; moving the rotating mold relative to the trough to dispose molten metal into the mold, wherein the movement is controlled to deliver a volume of molten metal to said mold to cast said object in accordance with predetermined specifications; recording a predetermined set of parameters characterizing said movement and actual specifications of said object as cast; repeating the foregoing steps a statistically significant number of times; and performing a regression analysis on the recorded parameters, recorded specifications, and fluidities calculated from the liquidus arrest temperatures and pour temperatures to produce control equations relating said parameters, specifications, and fluidities.

Another embodiment comprises an apparatus for centrifugally casting an object from molten metal, comprising a rotating mold; a trough for receiving molten metal poured from a container and delivering molten metal into said mold; a drive system for moving said trough or mold relative to the other; a controller for controlling said drive system; a computer for programming said controller to control said drive system to provide prescribed movement of said mold and delivery system relative to one another; a cup comprising a thermocouple in communication with said computer for measuring the liquidus arrest temperature of said molten metal; and a pyrometer for measuring the pour temperature of said molten metal. The computer computes fluidity of said molten iron from the measured liquidus arrest and pour temperature. The computer is programmed with a transfer function relating fluidity to volumetric requirements of molten metal for casting an object of predetermined specifications on the mold and the corresponding relative movement of the trough and the mold to make the casting as specified. The computer then programs the controller to control said drive system to cause the relative movement to dispose molten metal into the mold in accordance with the volumetric requirements.

BRIEF DESCRIPTION OF THE DRAWINGS

The present invention will be explained, by way of example only, with reference to certain embodiments and the attached figures, in which.

DETAILED DESCRIPTION

Embodiments of the present invention provide a method for automatically controlling the movement of a casting machine in the process of centrifugal casting of an object as a function of the fluidity of the molten metal with which the object is being cast, even where the precise chemical composition of the molten metal is unknown, based upon the measured liquidus arrest temperature of the molten metal and its pour temperature. A preferred embodiment calculates fluidity of the molten iron used in each casting, accounting for variations from one pour to the next, and in real time determines the precise casting machine movement required to cast an object of the desired specifications from metal of such fluidity and programs a programmable logic controller to such casting machine movement, thus making necessary adjustments to casting machine movement dynamically after molten metal is poured to a conveying system and before it reaches the mold. Additional embodiments of the present invention provide a method of determining the transfer function of fluidity of molten metal to casting machine movement for the casting of a particular object according to predetermined specifications in a given casting machine. Another embodiment of the present invention comprises an apparatus to practice the foregoing methods.

This disclosure will describe certain embodiments of the invention with respect to an exemplary application of centrifugal casting of iron pipe of uniform diameter with a constant wall thickness. Embodiments of the present invention may be readily applied to produce pipe of varying (tapering)

diameter or cross-sectional profiles (e.g., hexagonal), with varying wall thickness along the length of the pipe. It should be also understood that embodiments of the present invention may be practiced with respect to the centrifugal casting of any object from molten metal of other alloys, by using known metallurgical relationships for such alloys in place of such relationships as described in this disclosure with respect to iron. Further, a reference to iron should be understood as a reference to an alloy of iron, typically comprising quantities of carbon, silicon, and phosphorous, but which also may comprise quantities of other elements or compounds that may affect its properties. Embodiments of the method and apparatus of the present invention are ideally suited to casting objects within a desired tolerance from iron or other molten metal having varying or unknown composition from batch to batch in the casting process.

Figure 1:
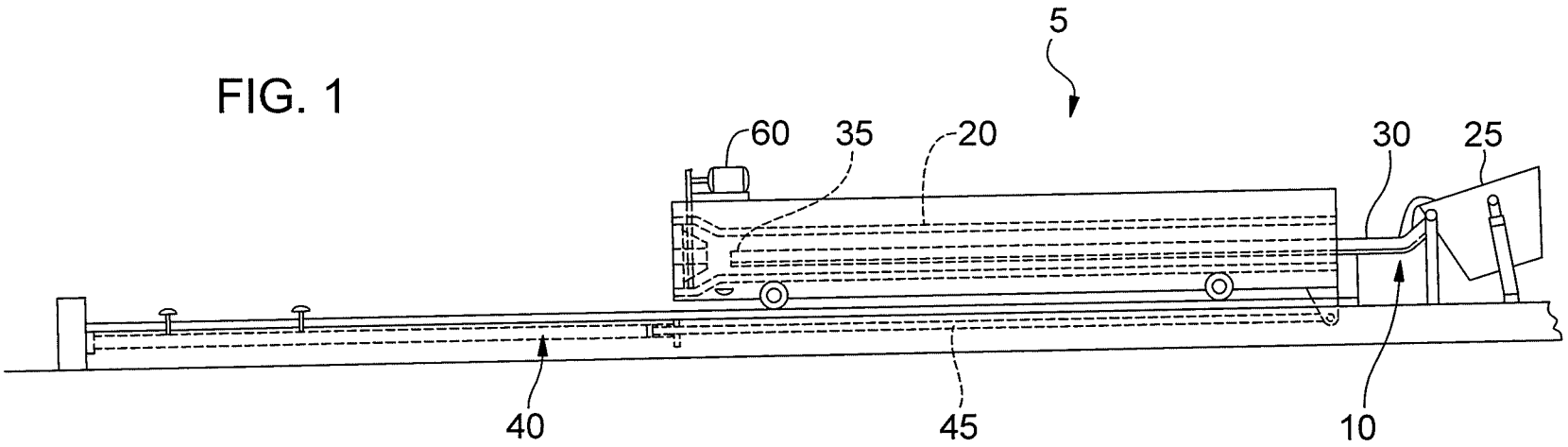
FIG. 1 is an exemplary embodiment of a casting machine, which forms part of an apparatus of the present invention.
Figure 2:
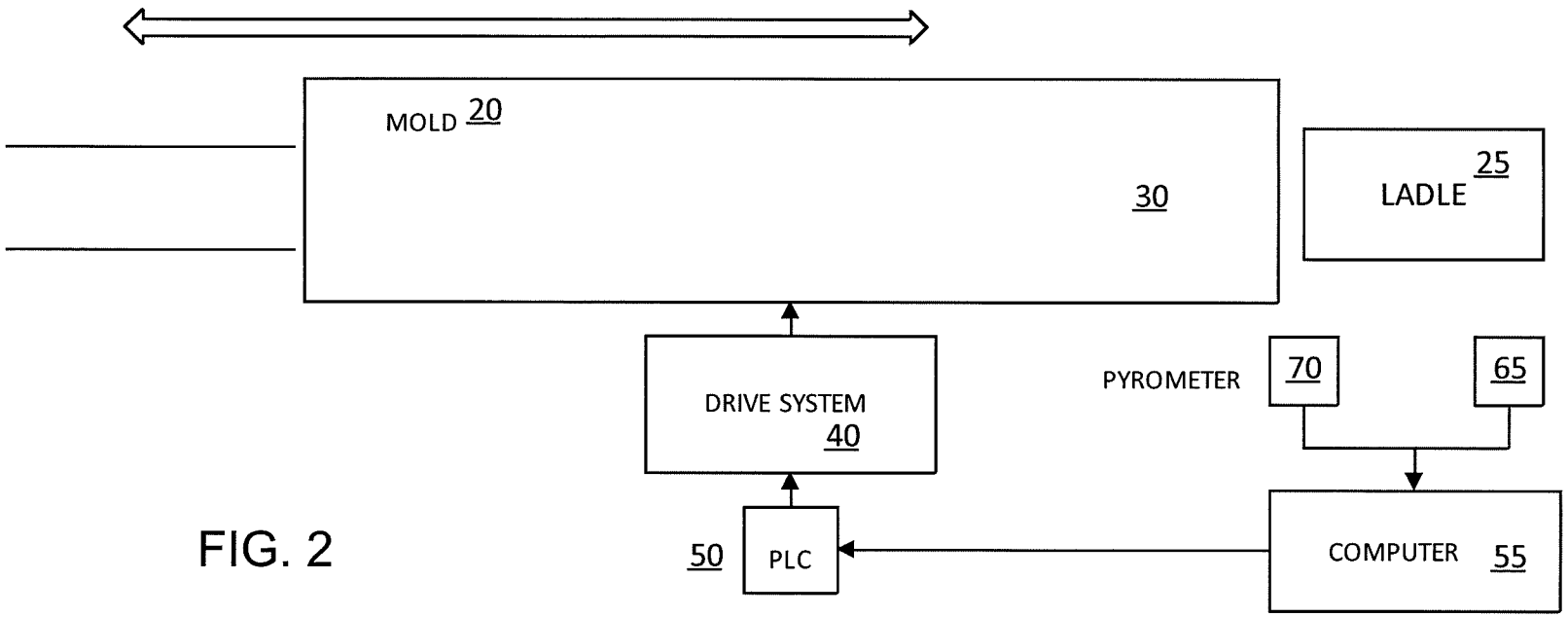
FIG. 2 is a block diagram of an embodiment of the apparatus of the present invention.

FIG. 1 illustrates an exemplary embodiment 100 of an apparatus of the present invention. As shown in FIG. 1, a casting machine 5 is a typical centrifugal casting machine as is known in the art, which comprises a conveying system 10 to transport a quantity of molten iron into a rotating mold 20. In a preferred embodiment, the conveying system 10 comprises a machine ladle or other container 25 that contains the molten iron and a U-shaped trough 30. The machine ladle 25 preferably dispenses a constant volume of iron per degree of rotation. (It should be noted, however, that the method of the present invention can be used with any type of ladle, so long as it provides a consistent pour profile from one pour to the next.) The trough 30 is angled slightly downward and extends axially into the interior of the mold 20, terminating at a spout 35. When the machine ladle 25 is tilted, molten iron flows from the lip of the ladle 25, down the trough 30, out the spout 35 and into the mold 20 under the influence of gravity. The mold 20 is mounted to a drive system 40. The drive system 40 comprises actuators 45 to move the mold back and forth within a fixed range of motion with respect to the fixed end (i.e., spout 35) of the conveying system 10. The actuators 45 may be any type of actuator known in the art to move the mold 20, including hydraulics, electrical motors, a belt or chain-drive mechanical linkage to an engine or motor, any combination thereof, or other means known in the art for moving a mold. In some embodiments, the conveying system 10 is moved longitudinally by a drive system 40 with respect to the mold 20, which remains fixed in position. In this disclosure, the terms casting machine velocity or casting machine movement refer to movement (or the rate thereof) of the drive system 40 relative to the mold 20, and may describe an apparatus in which either or both components move relative to the other. As shown in FIG. 2, in each embodiment, the drive system 40 is preferably controlled by a programmable logic controller (PLC) 50 that receives commands from a computer system 55. The casting machine further comprises a motor 60 that rotates the mold 20 during the casting process. Hence, molten iron is delivered to the rotating mold 20 via the conveying system 10, and the mold 20 is moved with respect to the conveying system 10 such that molten iron is disposed along the length of the mold in a volume intended to provide a cast object (as illustrated, a pipe) having predetermined specifications, including for example, wall thickness.

The embodiment 100 further comprises instruments for measuring the liquidus arrest temperature and pour temperature of the molten iron. Because the chemical composition of the molten metal may vary from batch to batch, the liquidus arrest temperature cannot be calculated directly. As a molten metal cools, the liquidus arrest temperature (as well as information regarding its chemical composition) can be determined from the profile of its temperature variation over time, i.e., its cooling curve, as is known in the art. This determination is typically made by using a commercially available disposable cup, comprising a thermocouple, for thermal analysis of molten metal. Molten metal is poured into the cup, and the output of the thermocouple is analyzed to determine the properties of the molten metal. In a preferred embodiment, a QuiK-Cup QC 4010 manufactured by the Heraeus Electro-Nite company is used to determine the liquidus arrest temperature of molten iron. As shown in FIG. 2, in a preferred embodiment, the output of the cup 65 is captured by a computer system 55. The computer system 55 analyzes the cooling curve of the molten iron in the cup 65 to determine the liquidus arrest temperature.

The pour temperature (T) of the molten metal is the actual temperature of the molten metal as poured from the machine ladle 25 into the trough 30. There are many instruments known in the art for measuring pour temperature of a molten metal, and any such instrument may be used. In a preferred embodiment, a dual color infrared pyrometer 70 is used. The pyrometer 70 allows accurate measurement of the pouring temperature even in the presence of occluding smoke and variations in the emissivity in the sample stream. The output of the pyrometer 70 is input into the computer system 55, preferably by coupling the pyrometer directly to a data acquisition or other input port on the computer system 55.

Figure 3A:
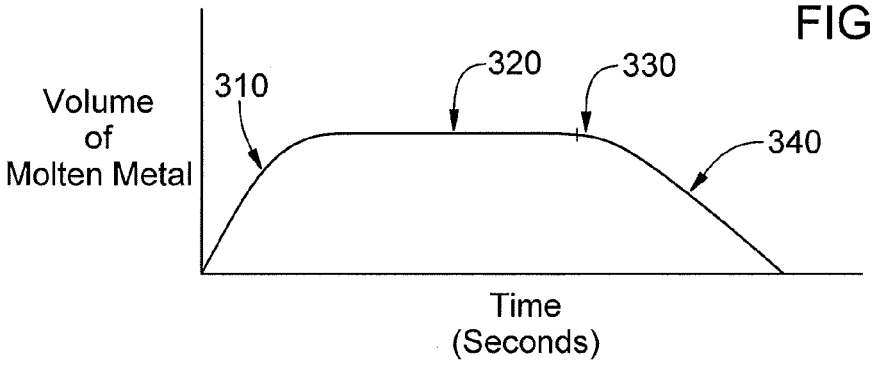
FIG. 3A is an exemplary delivery profile of molten iron poured from a machine ladle traveling down a trough to a mold.

FIG. 3A illustrates an exemplary profile of the volume of iron delivered from a conveying system 10 to a mold 20 over time. As molten iron is initially poured over the lip of the machine ladle 25 and travels down the trough 30, the volume of iron builds, as shown by segment 310 of the profile. As the cycle continues, the iron flow reaches a constant state, as shown by segment 320. Near the end of the casting cycle as the machine ladle 25 is cut back at point 330, the flow volume is reduced, as shown by segment 340, and then stops. The actual iron delivery flow curve for a given pour of molten iron, especially sourced from recycled materials, is very difficult to predict and varies from batch to batch of molten iron. As a result, casting an object within close tolerances of a given set of specifications can be difficult.

Figure 3B:
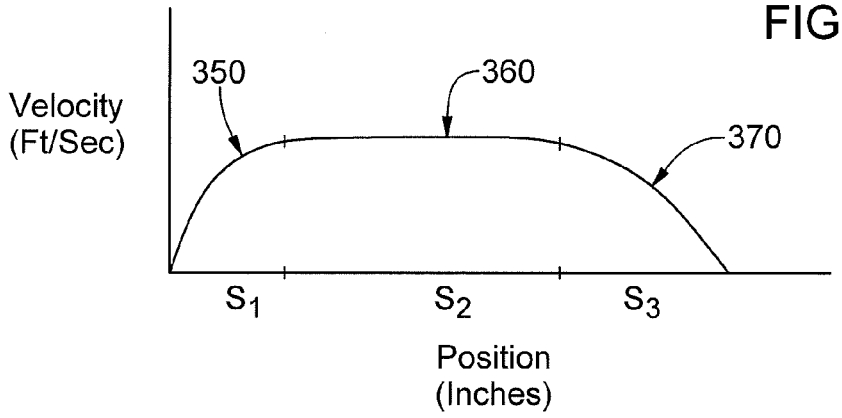
FIG. 3B is an exemplary transfer function relating casting machine movement to the delivery of profile of FIG. 3A to achieve uniform volumetric delivery.
Figure 3C:
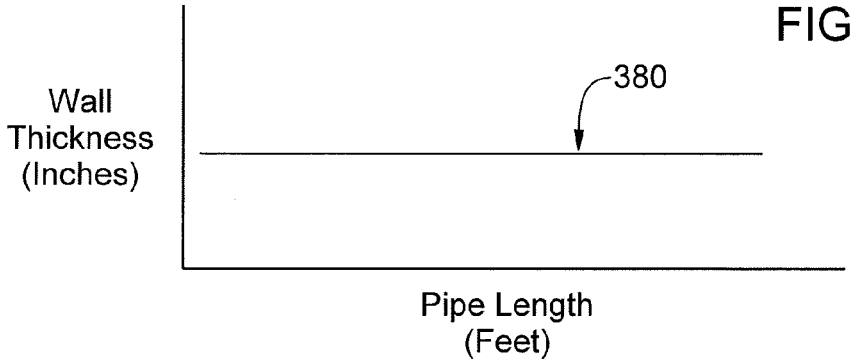
FIG. 3C is a profile of uniform volumetric delivery achieved by casting machine movement in accordance with the transfer function of FIG. 3B and the molten metal delivery profile of FIG. 3A.

In one embodiment, the object to be cast is a pipe of uniform wall thickness, as shown in FIG. 3C. Wall thickness is a function of iron delivery to the mold, and therefore the volume of iron delivered per unit distance should be constant over the length of the mold to provide pipe of uniform wall thickness, shown as line 380. The uniform wall thickness (or other desired specification) can be achieved by control of the movement of the conveying system 10 relative to the mold 20 according to a transfer function that accurately relates the required acceleration, deceleration, and velocity of the relative motion of the casting machine 5 to the volumetric delivery requirements of the mold 20 to achieve the desired specifications. An example of such a transfer function, showing casting machine velocity to position of the spout 35 of the trough 30, is shown in FIG. 3B. The casting machine accelerates through section $S_1$, corresponding to the bell of the pipe, as shown by curve 350. The machine reaches a constant velocity in section $S_2$, corresponding to the barrel of the pipe, as shown by line 360. The machine then decelerates in section $S_3$, corresponding to portion of the barrel near the spigot and the spigot of the pipe, as shown by curve 370. In one embodiment, the position of the spout over these segments may be characterized by the following equations:

$$S_1=0.5*at^2$$

$$S_2=vt$$

$$S_3=0.5*at^2$$

where a is casting machine acceleration, t is time, and v is velocity. The PLC 50 is thus programmed by computer 55 to control the casting machine 5 in accordance with the output of such a transfer function to provide the appropriate movement to cast the object with the desired specifications.

Fluidity is a critical determinant in the rate of molten metal movement associated with the delivery flow curve, such as shown in FIG. 3A. The fluidity of molten iron can be calculated from the liquidus arrest temperature and the pour temperature. A transfer function can be developed to relate the calculated fluidity to movement of the casting machine 5 to produce an object having a predetermined set of specifications.

First, the fluidity must be calculated. Equation (1) is the standard equation for calculating fluidity from a carbon equivalent:

$$\text{Fluidity}=14.9*CE+0.05T-155 \quad (1)$$

As noted, the presence of unknown compounds in molten iron from recycled materials precludes reliance on the standard formula (Equation (2)) to accurately calculate the carbon equivalent. However, an equation for determining a composition factor for molten iron, which can be substituted for the value of the carbon equivalent in Equation (1), can be determined by multiple regression analysis of thermal properties of molten iron in a given environment. Such regression analysis is performed by manufacturers of disposable cups for thermal analysis of molten iron, such as cup 60. The Heraeus Electro-Nite company, the manufacturer of the QuiK-Cup QC 4010 which is preferably used as cup 60, provides the following equation, developed from multiple regression analysis, for calculation of a composition factor of molten iron from liquidus arrest temperature measured in the QC 4010 cup:

$$CF=14.45-0.0089*((LA-32)*0.5556) \quad (4)$$

where LA is the measured liquidus arrest temperature in degrees Fahrenheit. Substituting Equation (4) for the carbon equivalent in Equation (1) provides an equation from which fluidity may be calculated based on measured pour temperature (T) and liquidus arrest temperature (LA):

$$\text{Fluidity}=14.9*(14.45-0.0089*((LA-32)*0.5556))+0.05T-155 \quad (5)$$

where fluidity is in inches and all temperatures are in degrees Fahrenheit. Table 1 below shows the fluidity, according to Equation (5), at various liquidus arrest (LA) and pouring (T) temperatures.

TABLE 1

| | | LA (° F.) | | | | | | | | | | |
|---|---|---|---|---|---|---|---|---|---|---|---|---|
| | | 2040 | 2060 | 2080 | 2100 | 2120 | 2140 | 2160 | 2180 | 2200 | 2220 | 2240 |
| T (° F.) | 2250 | 24.86 | 23.39 | 21.91 | 20.44 | 18.97 | 17.49 | 16.02 | 14.54 | 13.07 | 11.60 | 10.12 |
| | 2275 | 26.11 | 24.64 | 23.16 | 21.69 | 20.22 | 18.74 | 17.27 | 15.79 | 14.32 | 12.85 | 11.37 |
| | 2300 | 27.36 | 25.89 | 24.41 | 22.94 | 21.47 | 19.99 | 18.52 | 17.04 | 15.57 | 14.10 | 12.62 |
| | 2325 | 28.61 | 27.14 | 25.66 | 24.19 | 22.72 | 21.24 | 19.77 | 18.29 | 16.82 | 15.35 | 13.87 |
| | 2350 | 29.86 | 28.39 | 26.91 | 25.44 | 23.97 | 22.49 | 21.02 | 19.54 | 18.07 | 16.60 | 15.12 |
| | 2375 | 31.11 | 29.64 | 28.16 | 26.69 | 25.22 | 23.74 | 22.27 | 20.79 | 19.32 | 17.85 | 16.37 |
| | 2400 | 32.36 | 30.89 | 29.41 | 27.94 | 26.47 | 24.99 | 23.52 | 22.04 | 20.57 | 19.10 | 17.62 |
| | 2425 | 33.61 | 32.14 | 30.66 | 29.19 | 27.72 | 26.24 | 24.77 | 23.29 | 21.82 | 20.35 | 18.87 |
| | 2450 | 34.86 | 33.39 | 31.91 | 30.44 | 28.97 | 27.49 | 26.02 | 24.54 | 23.07 | 21.60 | 20.12 |

Having established a method to calculate fluidity, equations to provide a transfer function to relate fluidity to casting machine movement to cast an object in accordance with predetermined specifications can be developed from a regression analysis of a statistically significant sample of data for casting the object. A transfer function is preferably developed for each object with a given set of specifications for each casting machine on which each such object will be cast. For example, with respect to pipe, a transfer function is developed—by repeating the process described in the following paragraphs—for each diameter and class of pipe (such as 8" class 52 ductile iron pipe) and for each individual casting machine on which each such pipe category will be cast.

Figure 4:
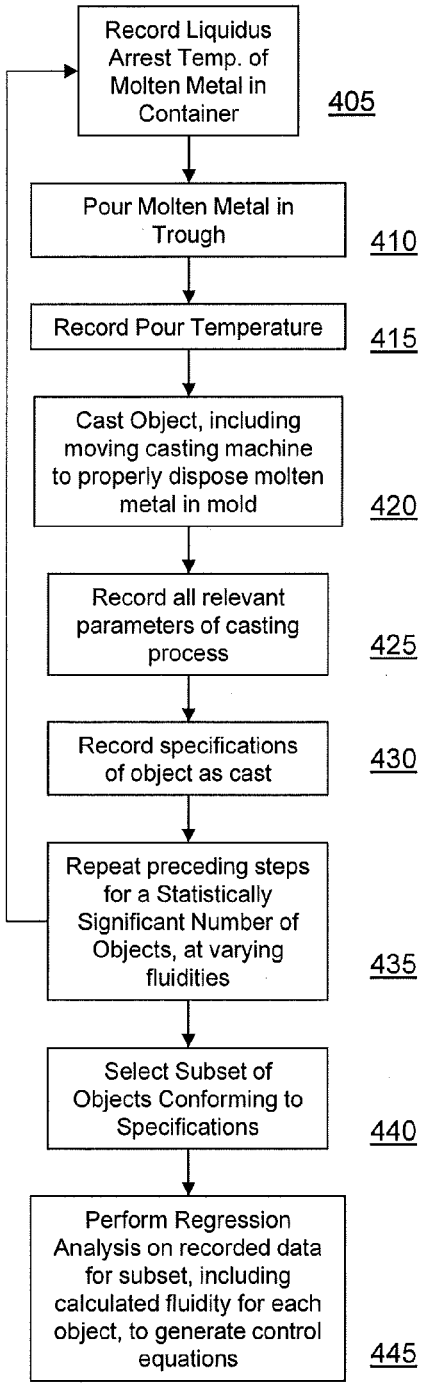
FIG. 4 is a flow chart of one embodiment of the method of the present invention, namely a process to determine control equations that constitute a transfer function relating fluidity of molten metal to volumetric requirements of a mold to cast an object on a casting machine with predetermined specifications.

FIG. 4 illustrates an embodiment of a process to determine control equations that provide the transfer function to relate the fluidity of molten metal to the volumetric requirements of a rotating mold for the centrifugal casting of a particular object according to predetermined specifications in a given casting machine, via controlled movement of the casting machine. An apparatus such as that shown in FIGS. 1-2 may be utilized to practice this method. As a preliminary matter, all instrumentation should be calibrated and in good working order. As shown in step 405, the liquidus arrest temperature of the molten metal is measured and recorded, preferably by transferring a sample of molten metal from the container holding the metal to the cup 65 which allows the computer 55 to capture the actual liquidus arrest temperature of the molten iron that will be used in the casting. It should be noted that in a typical foundry setting, each batch of molten iron is made in a container referred to as a treating ladle (which holds a sufficient volume of iron to cast multiple objects), and then a volume of iron to cast one unit is transported to the machine ladle 25. Therefore, in such a facility, the liquidus arrest temperature may be measured for a single batch of molten metal from the treating ladle, rather than from the machine ladle 25. Next, as shown in step 410, molten metal is poured into the trough 30 to deliver the molten iron to the rotating mold 20. As the metal is poured, the pour temperature is measured and recorded in step 415 using pyrometer 70 or other suitable instrument, preferably in communication with computer 55. Next, in step 420, the object is cast, in an exemplary embodiment a pipe, by moving the casting machine (i.e., the mold 20 with respect to the conveying system 10, or vice versa) preferably with the drive system 40 controlled by computer 55 and PLC 50 to deliver a desired volume of molten metal to the mold to attempt to cast the object in accordance with the required specifications, per typical industry practice. The specifications may include wall thickness at defined points or intervals on the object. As shown in step 425, all relevant parameters of the casting process are recorded, and the fluidity of the molten iron is calculated in accordance with Equation (5) based on the liquidus arrest and pour temperatures measured and recorded during the casting of the object. The relevant parameters include the elapsed time and casting machine movement (e.g., position, velocity, and acceleration) during each portion of the delivery cycle depicted in FIG. 3A. Recordation of these parameters is preferably performed by the PLC 50 in conjunction with the computer 55, although other instrumentation can be used.

Without limitation, the parameters include the following. The initial delay corresponding to the time elapsed from when molten metal leaves the spout of the trough until a predetermined volume of molten metal is disposed in the mold is recorded, with the corresponding machine movement. In the example of casting pipe, this corresponds to the time from when molten iron leaves the spout until the bell of the pipe mold is filled, which is known as the flag delay time, during which the casting machine is stationary with the trough near the end of barrel of the pipe disposing molten iron into the bell. The acceleration and positioning of the machine and elapsed time as the volume of iron increases during the next phase of the delivery cycle are recorded. In the example of a pipe, this typically corresponds to the filling of a portion of the barrel near the bell end of the mold 20. Likewise, the elapsed time and machine velocity while the movement of the trough relative to the mold is at a constant velocity during the time period in which the volumetric delivery of molten iron is constant are recorded. In the example of a pipe, this corresponds to the filling of the mold along much of the length of the barrel. The deceleration of the machine and elapsed time as the volume of iron decreases after the machine ladle stops pouring molten iron into the trough are recorded. In the example of a pipe, this corresponds to the filling of a portion of the barrel near the spigot end of the pipe. Finally, a delay time corresponding to the elapsed time from the time at which the casting machine is stopped at the end of the mold 20 until molten metal ceases to pour from the spout 35 of the trough 30 into the mold 20. In the example of a pipe, this corresponds to the time in which the casting machine is stationary at the end of the spigot end of the mold, and is referred to as the spigot check time or dwell time.

In addition to recording parameters relating to elapsed time and corresponding movement of the casting machine during each phase of the metal delivery cycle, the actual specifications of the object as cast are measured, as shown in step 430. The set of specifications measured correspond to the desired or predetermined set of specifications for the object that the casting process was intended to achieve, including for example, wall thickness. For the example of a pipe, typically multiple measurements of wall thickness are taken at regular intervals along the length of the pipe, typically two measurements at locations diametrically opposed (i.e., 180 degrees apart) at one-foot intervals from the bell to the spigot of the pipe. These specifications as actually measured indicate the uniformity of the object over its length, the compliance with the predetermined specifications, and the extent to which the casting machine movement was matched to the molten metal delivery profile to provide the required volume of metal along the length of the mold.

As shown in step 435, the foregoing process is repeated for a statistically significant number of objects, for which multiple batches of molten iron are used. Preferably, the composition of the molten metal changes somewhat from one batch to the next, and pour temperatures are deliberately varied, to model conditions that may be found in production using recycled source materials, so that castings will be made with molten iron of various fluidities. The casting machine movement may be adjusted as the recorded data is analyzed to cast objects that are closer to the desired specifications. After a statistically significant number of objects are cast, in step 440 a subset of the objects that most closely conform to the predetermined specifications, and which also were made from molten metal of various fluidities, is selected. In step 445, a regression analysis is performed on the data gathered for the selected subset of objects, including the recorded process parameters, the specifications of the objects as cast, and the fluidity calculated from the measured liquidus arrest and pour temperatures. The regression analysis provides control equations for each phase of the casting process, including the initial delay time, the acceleration period, the constant delivery period (if necessary), and deceleration period, and the second delay time. Depending on the shape and size of the object to be cast and corresponding mold, there could be other periods to accommodate the mold shape, for example, a deceleration phase to provide an increased wall thickness in a particular area or to fill a higher volume mold section. In the example of a pipe, control equations are developed for the flag delay time, the bell acceleration, the spigot deceleration, and the spigot check time.

In one example of the foregoing process, 100 pipe (class 52, 8-inch diameter) were cast from batches of molten iron of varying fluidity on a single casting machine. The liquidus arrest temperature, pour temperature, and process parameters for each pipe were recorded, as well as the wall thickness of each pipe at diametrically opposed locations at one-foot intervals down the length of the pipe. Fluidities for each pipe were calculated and recorded based on Equation (5) and the liquidus arrest temperature and pour temperature. A subset of the ten pipe having the most uniform wall thickness were selected. A regression analysis was run on the data collected on these pipe. The following control equations for flag delay time, the bell acceleration, the spigot deceleration, and the spigot check time were developed, which are shown in FIGS. 5A-D:

$$\text{Flag Delay Time}=-0.129(\text{Fluidity})+4.2654 \quad R^2=0.9837$$

$$\text{Bell Acceleration}=0.3814(\text{Fluidity})+12.34 \quad R^2=0.9952$$

$$\text{Spigot Deceleration}=0.058(\text{Fluidity})^2-0.6828(\text{Fluidity})+1.5036 \quad R^2=0.9993$$

$$\text{Spigot Check Time}=0.0082(\text{Fluidity})^2-0.3994(\text{Fluidity})+5.1153 \quad R^2=0.9831$$

where $R^2$ is the correlation factor indicating how closely the equation correlates to the data. It should be understood that the control equations shown in FIGS. 5A-D are illustrative only, for a single diameter and class of pipe on an individual casting machine.

Together, the control equations provide a transfer function relating casting machine movement to the molten metal delivery profile, as determined by calculated fluidity for each pour, to cast the object having predetermined specifications. The control equations are preferably loaded into computer 55 for control of the PLC 50, which in turn controls the movement of the conveying system 10 relative to the mold 20 in accordance with the transfer function.

Figure 6:
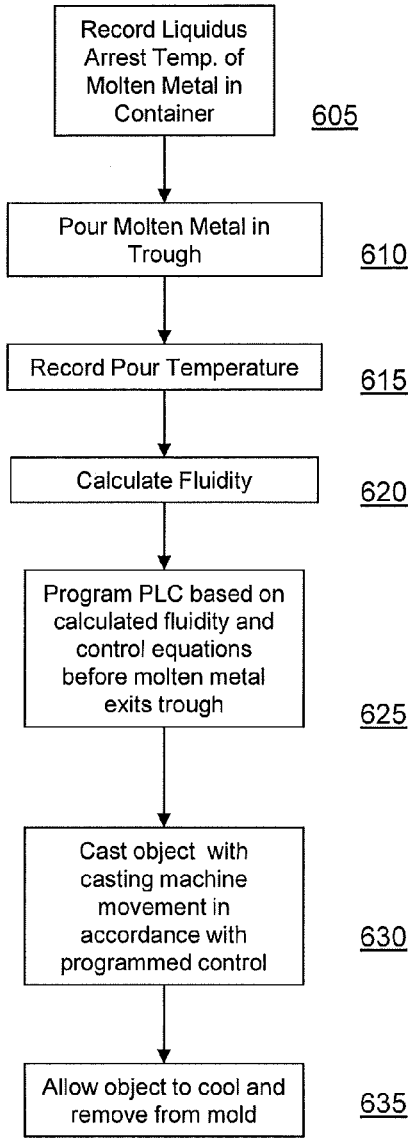
FIG. 6 is a flow chart of another embodiment of the method of the present invention, namely a process to centrifugally cast metal objects.
Figure 5A:
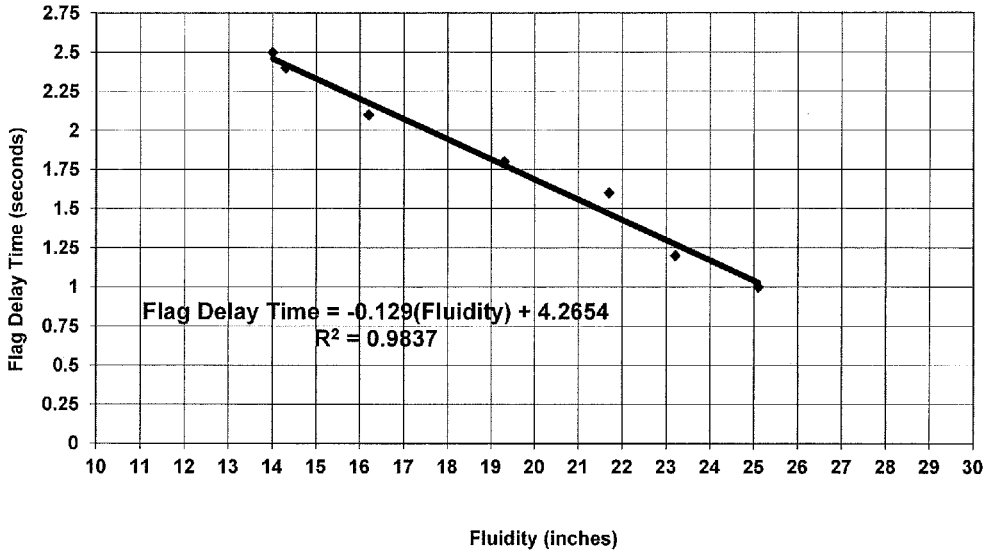
FIGS. 5A-D are graphs of exemplary control equations for cast iron pipe, which were developed in accordance with the embodiment of FIG. 4.
Figure 5B:
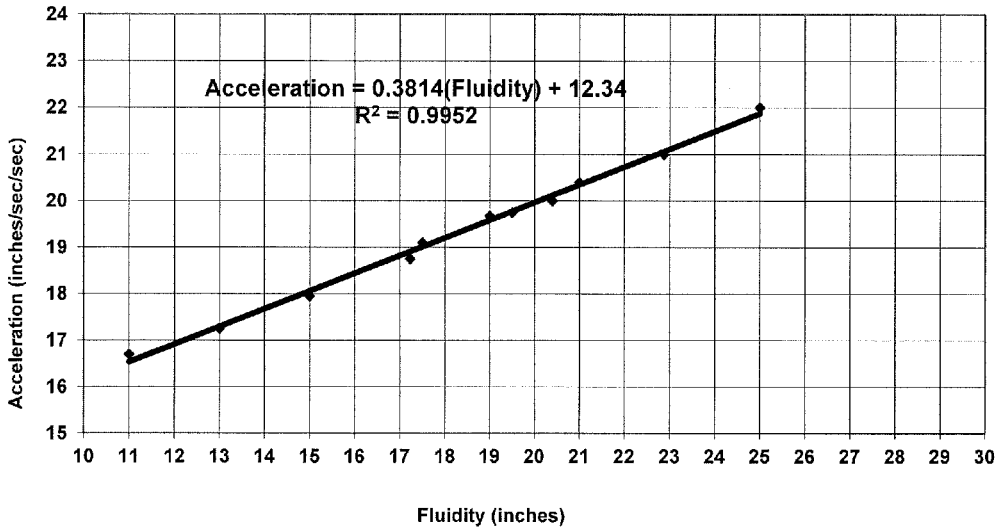
Figure 5C:
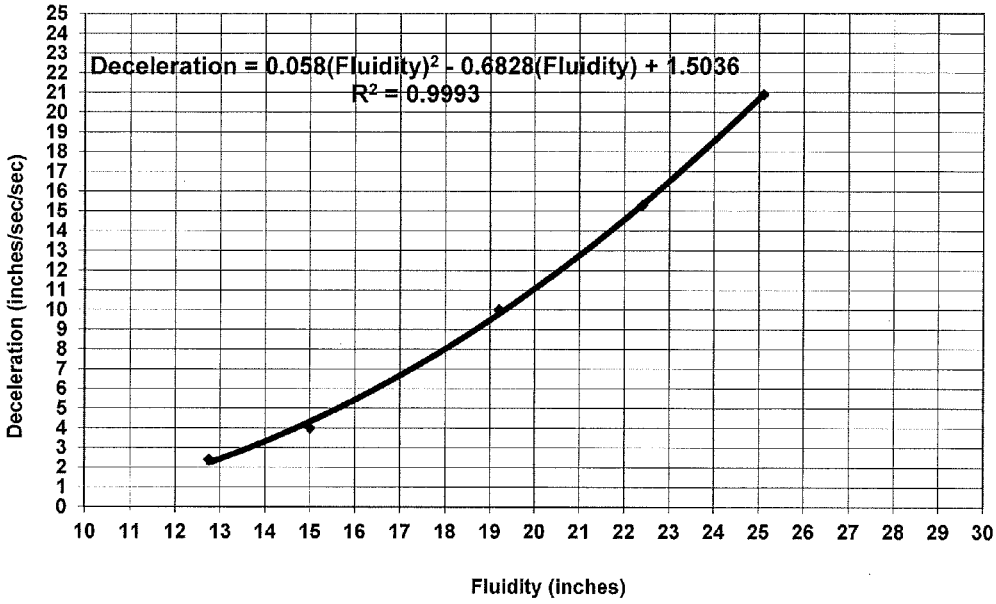
Figure 5D:
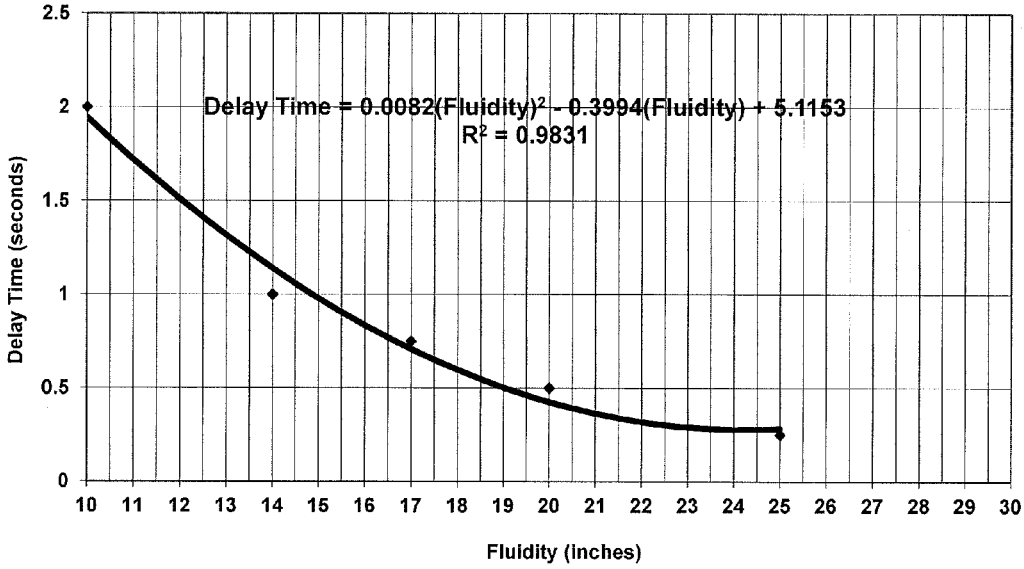

With the control equations loaded into computer 55, the process for casting an object in accordance with an embodiment of the present invention is shown in FIG. 6. A container, such as a treating ladle or machine ladle 25 is filled with molten metal. Typically, a batch of molten iron from the treating ladle contains sufficient molten metal to cast multiple objects. As described elsewhere in this disclosure, each batch of molten metal may vary in composition, especially where sourced from scrap or recycled materials. In step 605, the liquidus arrest temperature of the molten metal is measured, preferably by transferring a sample of the metal from the container (treating ladle or machine ladle 25) into the cup 65 which allows the computer 55 to capture the actual liquidus arrest temperature of the molten metal that will be used in the casting. Next, as shown in step 610, molten metal is poured into the trough 30 to deliver the molten iron to the rotating mold 20. As the metal is poured, the pour temperature is measured in step 615 using pyrometer 70 or other suitable instrument, preferably in communication with computer 55. With the liquidus arrest and pour temperature having been measured, the fluidity of the molten iron is calculated in step 620. Preferably, the liquidus arrest and pour temperatures were captured by computer 55, which automatically and rapidly calculates the fluidity. In a preferred embodiment using a Heraeus Electro-Nite QuiK-Cup QC 4010, the fluidity is calculated in accordance with Equation (5).

Using the control equations and the calculated fluidity, the proper movement of the casting machine can be determined, preferably with computer 55, and the casting machine controls (the PLC 50) can programmed dynamically, in step 625, before the molten metal exits the spout of the trough. Thus, the casting machine controls and consequent movement are adjusted in real time to compensate for any change in fluidity from cooling, however slight, of the molten metal from one pour to the next, or from the change in composition of the molten metal in the machine ladle 25, from one batch to the next.

Next, in step 630, the object is cast by moving the mold relative to the trough to dispose molten metal into the mold, where the movement is controlled based on the calculated fluidity to deliver a volume of molten metal to the mold to cast the object in accordance with the predetermined specifications. In a preferred embodiment, this movement is accomplished with the drive system 40 controlled by computer 55 and PLC 50, programmed dynamically as described in accordance with the transfer function relating fluidity to the volumetric requirements of the object being cast, for its predetermined specifications, and for the particular casting machine being used. The position and movement of the casting machine is controlled to match the metal delivery profile to the required volume of molten metal to each portion of the mold. Typically, this delivery is accomplished in accordance with control equations including the initial delay time, the acceleration phase, deceleration phase, and the final delay time, described above. After the final delay time has elapsed, the rotating mold is allowed to spin down, as shown in step 635, the cast object is allowed to cool, and the object is removed from the mold for further processing and finishing as needed.

Where multiple objects may be cast from the volume of molten metal held by a container such as a treating ladle or by machine ladle 25, the liquidus arrest temperature may be measured only one time for the casting of all objects from that batch of molten metal. The pour temperature, however, should be measured for each casting, as the molten metal in the machine ladle 25 cools over time and the pour temperature therefore typically decreases. As a result, the fluidity of the molten metal may change for each object cast from the same batch of molten iron. Because the composition of the molten metal may vary from batch to batch, the liquidus arrest temperature should be measured for each batch.

As objects are cast in a production environment, the relevant process parameters, object specifications, and fluidities can be recorded for each cast. Additional regression analyses may be performed on this increasing data set to further refine the control equations and transfer function for each class of object and casting machine.

The foregoing process may be used to centrifugally cast iron pipe. In one embodiment, the pipe has a bell, a spigot, and a barrel between the bell and spigot, with the mold 20 having corresponding sections. Specifications of the pipe may include a round cross section having a constant diameter barrel with wall thickness that is uniform within predefined tolerances. In other embodiments, the pipe may be hexagonal or other shape, have a non-uniform or tapered diameter or cross-sectional dimension, and have a uniform or non-uniform wall thickness, as the particular application may require. For example, it may be desired to have thicker walls at a wider base of a hexagonal cast iron utility pole, that tapers to a smaller cross section towards its top or tip end. In any embodiment, control equations may be developed for the object of desired specifications, as described herein.

Turning back to the embodiment of a constant diameter pipe having a bell, spigot, and barrel with uniform wall thickness, control equations for flag delay time, the bell acceleration, the spigot deceleration, and the spigot check time are loaded into computer 55. The liquidus arrest temperature of a batch of molten iron to be used in the casting is measured, preferably by cup 65 which provides a signal indicative of the temperature cooling profile of the iron to computer 55. Molten iron is poured from the machine ladle 25 into trough 30, and the pour temperature is measured, preferably by a pyrometer 70 in communication with computer 55. Computer 55 calculates the fluidity in based on the measured liquidus arrest and pour temperatures, computes the output of the control equations, and provides the corresponding commands to the PLC 50. The PLC 50 then moves the trough 30 relative to rotating mold 20 in accordance with the control equations above and the calculated fluidity to cast a pipe with the desired specifications.

Figure 7A:
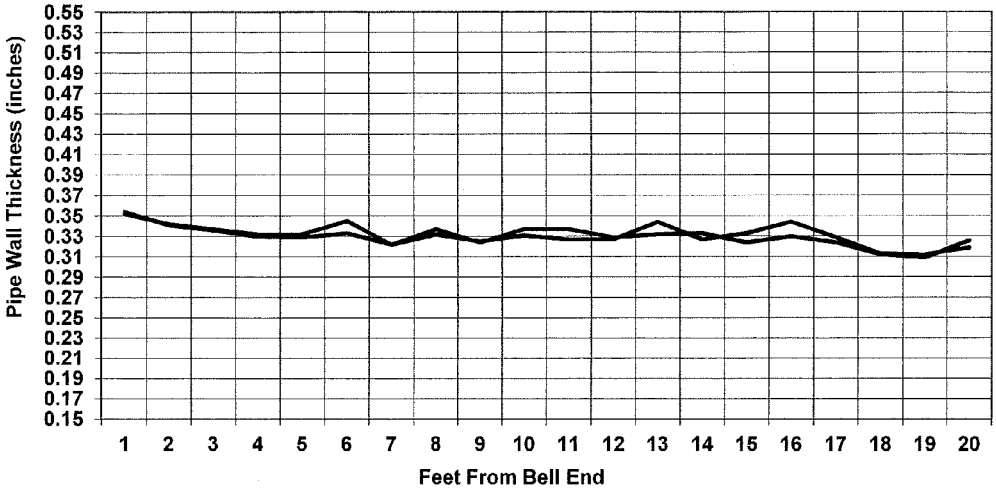
FIGS. 7A-B are exemplary charts showing uniformity of wall thickness of iron pipe, with FIG. 7A showing pipe cast in accordance with embodiments of the present invention, and FIG. 7B showing pipe cast in accordance with prior art methods.
Figure 7B:
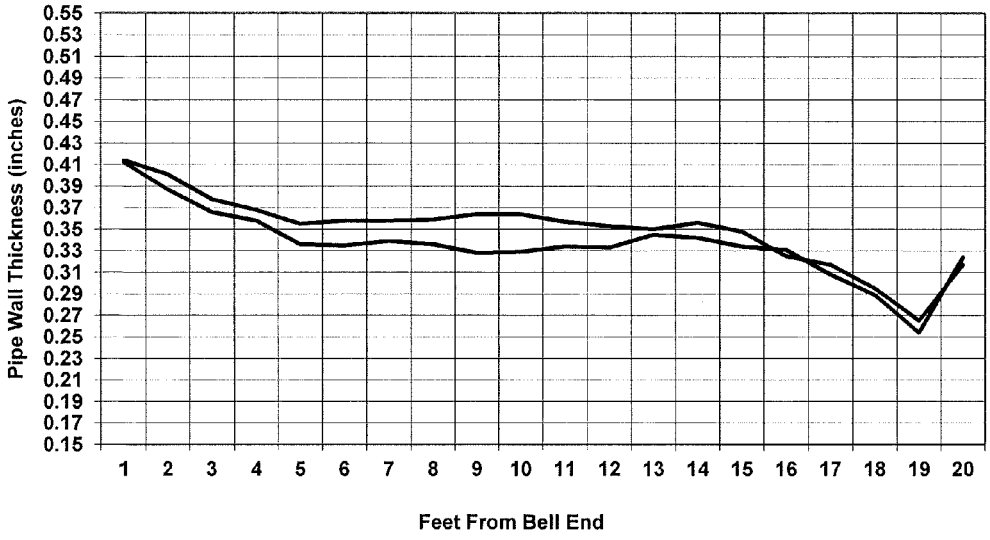
FIG. 7B (Prior Art)

It has been found that embodiments of the apparatus and methods of the present invention produce pipe with wall thickness of greater uniformity, and with tighter tolerances, than prior art methods. FIG. 7A illustrates the wall thickness of a twenty-foot pipe cast in accordance with an embodiment of the present invention. FIG. 7B illustrates the wall thickness of a twenty-foot pipe of the same specifications, cast on the same casting machine, in accordance with prior art methods. Measurements of wall thickness were taken at diametrically opposed locations at one-foot intervals along the length of each pipe. The figures plot the wall thicknesses on each side of the pipe as separate lines. As can readily be seen, the wall thickness of the pipe in FIG. 7A, cast in accordance with an embodiment of the present invention, is far more uniform over its length and circumference than the pipe shown in FIG. 7B cast in accordance with prior art methods.

The increased precision and control afforded by embodiments of the present invention allow pipe to be made with thinner walls than was previously possible. This saves significant material cost in molten metal and decreases the weight of the finished product. In addition, with thicker walled pipe, compliance with specifications and standards is ensured, and less material is wasted making pipe walls thicker than required for a given class. Following the casting, iron pipe is transported to an annealing oven, where the pipe is annealed at high temperature. Because pipe cast in accordance with embodiments of the present invention closely adhere to specification and use less material than prior art techniques, there is less iron to anneal, saving energy costs over time.

Although the present invention has been described and shown with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

What is claimed is:

1. An apparatus for centrifugally casting an object from molten metal, said molten metal having a liquidus arrest temperature and, when poured, a pour temperature, comprising a rotating mold;

a trough positioned to receive poured molten metal;

a drive system coupled to at least one of said trough or mold;

a controller for controlling said drive system;

a computer programmed with a transfer function relating fluidity calculated from a measured liquidus arrest temperature and a measured pour temperature to control of said drive system to provide prescribed movement of said mold and said trough relative to one another, said computer in communication with said controller;

a first temperature sensor positioned to measure said liquidus arrest temperature of said molten metal and operable to communicate said measured liquidus arrest temperature to said computer; and a second temperature sensor positioned to measure said pour temperature of said molten metal and operable to communicate said measured pour temperature to said computer.

2. The apparatus of claim 1, wherein said drive system comprises actuators to move said mold or said trough back and forth within a fixed range of motion.

3. The apparatus of claim 2, wherein said actuators comprise hydraulics, electrical motors, a belt or chain-drive linkage to an engine.

4. The apparatus of claim 1, wherein both said trough and said mold are moved relative to one another.

5. The apparatus of claim 1, wherein said first temperature sensor is a thermocouple.

6. The apparatus of claim 5, wherein said thermocouple comprises a disposable cup.

7. The apparatus of claim 1, wherein said second temperature sensor is a dual color infrared pyrometer.

8. The apparatus of claim 1, wherein said controller is a programmable logic controller that receives commands from said computer.

9. The apparatus of claim 1, wherein said trough is angled downward towards said mold and extends axially into the interior of the mold.

10. The apparatus of claim 1, wherein said container is a machine ladle.

11. An apparatus for centrifugally casting an object from molten metal, said molten metal having a liquidus arrest temperature and, when poured, a pour temperature, comprising a rotating mold;

a trough positioned to receive poured molten metal;

a drive system coupled to at least one of said trough or mold;

a programmable logic controller for controlling said drive system;

a computer programmed with a transfer function relating fluidity calculated from a measured liquidus arrest temperature and a measured pour temperature to control of said drive system to provide prescribed movement of said mold and said trough relative to one another, said computer in communication with said controller;

a cup comprising a thermocouple positioned to measure said liquidus arrest temperature of said molten metal and operable to communicate said measured liquidus arrest temperature to said computer; and a pyrometer positioned to measure said pour temperature of said molten metal and operable to communicate said measured pour temperature to said computer.

12. An apparatus for centrifugally casting an object from molten metal, said molten metal having a liquidus arrest temperature and, when poured, a pour temperature, comprising a rotating mold;

a trough for receiving molten metal poured from a container and delivering molten metal into said mold;

a means for moving said mold and said trough relative to one another;

a means for controlling the movement of said mold and said trough;

a means for programming the control of said mold and said trough to provide prescribed movement of said mold and trough relative to one another, said programming means programmed with a transfer function relating fluidity calculated from a measured liquidus arrest temperature and a measured pour temperature to said means for moving said mold and trough relative to one another;

a means for measuring said liquidus arrest temperature of said molten metal, said measuring means being in communication with said programming means;

a means for measuring said pour temperature of said molten metal, said measuring means being in communication with said programming means.

* * * * *